US009428940B1

(12) United States Patent
Patrick

(10) Patent No.: US 9,428,940 B1
(45) Date of Patent: Aug. 30, 2016

(54) THREE-WAY DOOR LATCH

(71) Applicant: Clarence E. Patrick, Brown Summit, NC (US)

(72) Inventor: Clarence E. Patrick, Brown Summit, NC (US)

( * ) Notice: Subject to any disclaimer, the term of this patent is extended or adjusted under 35 U.S.C. 154(b) by 0 days.

(21) Appl. No.: 14/731,957

(22) Filed: Jun. 5, 2015

(51) Int. Cl.

| | |
|---|---|
| ***E05C 1/06*** | (2006.01) |
| ***E05C 1/12*** | (2006.01) |
| ***E05B 63/14*** | (2006.01) |
| ***E05C 1/08*** | (2006.01) |
| ***E05C 1/16*** | (2006.01) |
| *E05C 1/00* | (2006.01) |
| *E05C 1/02* | (2006.01) |
| *E05C 1/04* | (2006.01) |
| *E05C 1/10* | (2006.01) |
| *E05C 9/00* | (2006.01) |
| *E05C 9/10* | (2006.01) |
| *E05B 65/10* | (2006.01) |

(52) U.S. Cl.
CPC ..... *E05B 63/14* (2013.01); *E05C 1/08* (2013.01); *E05C 1/16* (2013.01)

(58) Field of Classification Search
CPC ... Y10T 292/0834; E05B 63/14; E05C 1/08; E05C 1/16
USPC ..... 292/DIG. 21, DIG. 16, 32, 33, 34, 197, 292/137, 165, 166, 167, 168, 173, 174, 145, 292/41, 332, 333, 159; 70/107–109
See application file for complete search history.

(56) References Cited

U.S. PATENT DOCUMENTS

| | | | | |
|---|---|---|---|---|
| 279,334 A | | 6/1883 | Clark | |
| 536,957 A | * | 4/1895 | Klein | E05B 59/00 70/109 |
| 958,880 A | | 5/1910 | Lawson | |
| 1,075,914 A | * | 10/1913 | Hoes | E05C 9/06 70/107 |
| 1,387,573 A | * | 8/1921 | Wilson | 292/181 |
| 1,596,992 A | * | 8/1926 | Ognowicz | E05C 9/043 292/36 |

(Continued)

*Primary Examiner* — Kristina Fulton
*Assistant Examiner* — Faria Ahmad
(74) *Attorney, Agent, or Firm* — Blake P. Hurt; Tuggle Duggins P.A.

(57) ABSTRACT

A door latch for retaining a door to a door frame or floor at a plurality of locations adjacent a respective edge of the door includes a central latch disposed within the door and biased in an extended position, and at least one of an upper latch disposed within the door and biased in an extended position and a lower latch disposed within the door and biased in an extended position. The door latch further includes a lock set that is operable for simultaneously moving the central latch and the at least one of the upper latch and the lower latch from the extended position to a retracted position so as to release the door from the door frame. The door latch includes a rotatable central shaft operably coupled with a cam, and a connecting arm operably coupled with the cam and attached to an actuator rod. The actuator rod is connected to an inner sleeve moveably disposed within an outer housing of the upper latch or the lower latch. Movement of the actuator rod creates a tension force that is greater than the biasing force exerted on the inner sleeve to move the inner sleeve from the extended position to the retracted position.

1 Claim, 5 Drawing Sheets

(56) References Cited

U.S. PATENT DOCUMENTS 1,646,674 A * 10/1927 Angelillo ..... E05C 9/042 70/109
2,069,883 A * 2/1937 Hennicke ..... E05B 17/0025 292/39
2,169,692 A * 8/1939 Hansen ..... E05C 9/043 292/40
2,202,916 A * 6/1940 Mussa ..... E05C 7/06 292/177
2,597,459 A * 5/1952 Dickinson ..... E05D 13/1253 16/197
2,672,745 A * 3/1954 Marchetti ..... E05B 63/242 292/177
2,726,109 A * 12/1955 Bennett ..... E05C 17/446 292/153
2,729,089 A * 1/1956 Pelcin ..... E05B 47/0002 292/36
2,735,706 A * 2/1956 Pelcin ..... E05C 1/145 292/34
2,793,892 A * 5/1957 Hutterer ..... E05C 9/043 292/167
3,086,383 A * 4/1963 Scott ..... E05C 9/04 292/39
3,333,878 A * 8/1967 Pelcin ..... E05C 9/043 292/150
3,362,740 A * 1/1968 Burns ..... E05C 9/042 292/34
3,433,180 A * 3/1969 Shook ..... B61D 45/006 292/139
3,578,369 A * 5/1971 Coopersmith ..... E05C 7/06 292/182
3,582,122 A * 6/1971 Foster ..... E05B 63/20 292/21
3,953,061 A * 4/1976 Hansen ..... E05C 9/002 292/34
4,005,886 A * 2/1977 Lirette ..... E05C 7/06 292/177
4,227,723 A * 10/1980 Rosell ..... E05C 9/002 292/161
4,276,760 A * 7/1981 Nolin ..... E05B 59/00 292/21
4,362,328 A * 12/1982 Tacheny ..... E05C 9/043 292/36
4,387,917 A * 6/1983 Cocker ..... E05B 63/20 292/40
4,445,717 A * 5/1984 Imhoff ..... E05B 17/0058 292/177
4,611,840 A * 9/1986 Martin ..... E05C 7/06 292/177
4,641,865 A * 2/1987 Pastva ..... E05B 63/0069 292/5
4,934,800 A * 6/1990 Choi ..... E05B 53/00 292/172
5,005,881 A * 4/1991 Bailey ..... E05C 7/06 292/177
5,076,620 A * 12/1991 Campbell ..... E05C 1/065 292/138
5,498,038 A * 3/1996 Simon ..... E05B 15/0086 292/333
5,590,919 A * 1/1997 Germano ..... E05C 1/02 292/137
5,595,076 A * 1/1997 Weinerman ..... E05B 5/00 292/34
5,603,534 A * 2/1997 Fuller ..... E05B 55/005 292/2
5,782,114 A * 7/1998 Zeus ..... E05C 9/002 292/150
5,813,710 A * 9/1998 Anderson ..... E05B 5/00 292/150
5,820,173 A * 10/1998 Fuller ..... E05B 55/005 292/1
5,890,753 A * 4/1999 Fuller ..... E05B 55/00 292/142
5,911,763 A 6/1999 Quesada ..... 70/120
6,120,071 A * 9/2000 Picard ..... E05B 65/1046 292/165
6,217,087 B1 * 4/2001 Fuller ..... E05B 55/00 292/33
6,282,929 B1 * 9/2001 Eller ..... E05C 9/02 292/32
6,409,231 B1 * 6/2002 Rusiana ..... E05C 7/06 292/33
6,923,028 B2 * 8/2005 Caldwell ..... E05B 17/2023 292/148
7,410,195 B1 * 8/2008 Martin ..... E05B 47/0009 292/163
7,712,799 B2 * 5/2010 Peng ..... E05B 65/1013 292/137
7,752,875 B2 * 7/2010 Constantinou ..... E05C 9/1841 292/41
7,775,564 B2 * 8/2010 Moore ..... E05B 13/001 220/730
8,182,002 B2 5/2012 Fleming ..... 292/40
8,191,937 B2 * 6/2012 Lin ..... E05C 7/06 292/137
8,376,415 B2 * 2/2013 Uyeda ..... E05C 7/04 292/39
8,555,685 B2 * 10/2013 Frolov ..... E05B 47/0673 292/137
8,562,032 B1 * 10/2013 Lin ..... E05C 7/06 292/157
8,657,345 B1 * 2/2014 Shih ..... E05C 7/00 292/32
8,882,162 B2 * 11/2014 Uyeda ..... E05B 59/00 292/172
8,899,635 B2 * 12/2014 Nakanishi ..... E05B 63/0056 292/194
2002/0104339 A1 * 8/2002 Saner ..... E05C 9/1841 70/108
2009/0308112 A1 * 12/2009 Uyeda ..... E05C 7/04 70/91
2012/0139266 A1 * 6/2012 Chen ..... E05B 63/20 292/8
2014/0026489 A1 * 1/2014 Bauman ..... E05C 9/1841 49/394

* cited by examiner

THREE-WAY DOOR LATCH

FIELD OF THE INVENTION

The invention disclosed herein pertains generally to locking and latching devices, apparatus, systems and methods for retaining a hinged door to a stationary door frame or to another door. More particularly, the invention pertains to a door latch that is configured to simultaneously actuate a plurality of vertically and horizontally oriented sliding latches in response to operation of a single door handle to release the door from an adjacent door frame and/or another door.

BACKGROUND AND DESCRIPTION OF THE PRIOR ART

Locking and latching devices, apparatus, systems and methods are known for retaining a generally planar panel, such as a door, window, shutter or the like to a stationary, adjacent frame. In particular, numerous door locks and door latches are known for retaining a hinged door to a stationary door frame or to another door. One type of a known door lock includes a deadbolt that is movable between an extended, or locked, position and a refracted, or unlocked, position. One type of a known door latch includes a conventional sliding latch, also referred to as a striker plate latch. The sliding latch is biased outwardly to engage a recess provided within a door frame or within another door adjacent an edge of the door to maintain the door in a closed configuration. The common door locks and door latches are suitable for ordinary circumstances, but are usually insufficient for installations that require additional resistance against unintentional opening, for example hurricane doors intended to withstand high-force winds and security doors intended to prevent, or at least deter, crime. In those instances, it is desirable to provide one or more additional door locks or door latches that engage the door frame or the other door at an additional location.

U.S. Pat. No. 5,911,763 issued Jun. 15, 1999, to Quesada discloses a three-point lock mechanism including a central deadbolt for engaging a door jamb of a door frame adjacent a lateral edge of a door, an upper deadbolt for engaging a lintel of the door frame adjacent a top edge of the door, and a lower deadbolt for engaging a threshold, sill or floor adjacent a bottom edge of the door. A conventional deadbolt lock set for the central deadbolt has a circular plate that rotates when the lock is operated to drive upper and lower deadbolt actuation rods that actuate the upper deadbolt and the lower deadbolt, respectively. The upper and lower deadbolt actuation rods are pivotally secured to the circular plate one hundred thirty-five degrees (135°) apart from one another and at a different radius from the center of the plate. In this manner, the upper and lower deadbolt actuation rods move an equal linear travel distance when the circular plate is rotated in response to operation of the lock set. An over-center pivot at the outer end of each of the upper and lower deadbolt actuation rods simultaneously actuates the upper deadbolt and the lower deadbolt, respectively, to move between a retracted, or unlocked, position and an extended, or locked, position.

Although generally effective, the three-point lock mechanism taught by Quesada is mechanically complex, and consequently, subject to malfunction, for example jamming, or failure. Furthermore, the over-center pivots and the spatial relationship of the attachment points of the upper and lower actuation rods on the circular plate bias the deadbolts towards the locked position when the lock set is moved to the locked configuration, and conversely, bias the deadbolts towards the unlocked position when the lock set is moved to the unlocked configuration. As a result, the biasing force created by the over-center pivots and the spatial relationship of the attachment points of the actuation rods must be overcome to either lock the door lock or to unlock the door lock.

It is therefore desirable to provide a locking or latching device, apparatus, system and method that overcomes the problems, deficiencies and shortcomings associated with known locking and latching mechanisms. It is further desirable to provide a locking or latching device, apparatus, system and method that retains a generally planar panel, such as a door, window, shutter or the like, at multiple locations adjacent an edge of the panel. It is still further desirable to provide a three-way door latch that retains a hinged door to a stationary door frame at a central sliding latch, an upper sliding latch and a lower sliding latch, and simultaneously releases the sliding latches of the door in a mechanically simplistic manner that is not susceptible to malfunction or failure.

In view of the aforementioned desires, the present invention was conceived and has as an objective to provide an improved locking or latching device, apparatus, system and method for retaining a hinged door to a stationary door frame or to another door adjacent a lateral edge of the door. The invention has as a further objective to provide a three-way door latch including a central sliding latch, an upper sliding latch and a lower sliding latch that retain a hinged door to a door frame and simultaneously release the door from the door frame in response to a single operation utilizing a simplistic mechanism that is not inherently susceptible to malfunction or failure.

Various other objectives and advantages of the present invention will become apparent to those skilled in the art as a detailed description of one or more exemplary embodiments of the invention is set forth below.

SUMMARY OF THE INVENTION

The aforementioned, as well as other objectives not expressly set forth herein, are realized by providing a latching device, apparatus, system and method for securing a door to a door frame or another door at multiple locations adjacent an edge of the door. Latching devices, apparatus, systems and methods constructed according to the present invention are shown and described by one or more exemplary embodiments disclosed herein.

In one aspect, the present invention is embodied by a latching device for retaining a generally planar panel with a stationary frame at a plurality of locations on the stationary frame and adjacent a respective edge of the panel. The latching device includes a central latch that is biased towards an extended position and at least one of an upper latch that is biased towards an extended position and a lower latch that is biased towards an extended position. The latching device further includes a lock set operable for simultaneously moving the central latch and the at least one of the upper latch and the lower latch from the extended position to a retracted position. In one embodiment, the lock set includes a rotatable central shaft that is operably coupled with a moveable inner sleeve of the central latch such that movement of the central shaft moves the inner sleeve of the central latch between the extended position and the retracted position. In another embodiment, the lock set further includes a cam that is operably coupled with the central shaft and a connecting arm that is operably coupled with the cam and attached to an actuator rod. Rotation of the central shaft results in movement of the actuator rod that causes a movable inner sleeve of the upper latch or the lower latch to move between the extended position and the retracted position.

In another aspect, the present invention is embodied by a door latch for retaining a door with a stationary door frame, another door or a floor at a plurality of locations adjacent a respective edge of the door. The door latch includes a central latch that is disposed within the door and biased in an extended position relative to a first edge of the door, and at least one of an upper latch that is disposed within the door and biased in an extended position relative to a second edge of the door and a lower latch that is disposed within the door and biased in an extended position relative to a third edge of the door. The door latch further includes a lock set and operation of the lock set causes simultaneous movement of at least two of the central latch, the upper latch and the lower latch from the extended position to a retracted position. In one embodiment, the lock set further includes a rotatable central shaft and rotation of the central shaft results in the simultaneous movement of the at least two of the central latch, the upper latch and the lower latch. The lock set further includes a cam that is rotatably coupled with the central shaft such that rotation of the central shaft causes simultaneous rotation of the cam. The lock set further includes a connecting arm that is operably coupled with the cam and attached to an actuator rod of the at least one of the upper latch and the lower latch. Rotation of the cam causes movement of the actuator rod of the at least one of the upper latch and the lower latch in an inward direction relative to the door, and thereby releases the door from the door frame.

In yet another aspect, the present invention is embodied by a method for retaining a generally planar panel with a stationary frame at a plurality of locations on the stationary frame adjacent a respective edge of the panel and for releasing the panel from the stationary frame. The method includes providing a lock set including a rotatable central shaft. The method further includes providing a central latch that is biased in an extended position relative to the panel. The method further includes providing at least one of an upper latch that is biased in an extended position relative to the panel and a lower latch that is biased in an extended position relative to the panel. The method further includes operating the lock set to rotate the central shaft such that at least two of the central latch, the upper latch and the lower latch are simultaneously moved from the extended position to a retracted position relative to the panel. In one embodiment, the lock set further includes a cam operably coupled with the central shaft and a connecting arm operably coupled with the cam and attached to an actuator rod, and rotation of the central shaft by operation of the lock set causes a corresponding movement of the cam and the actuator rod that results in movement of the at least one of the upper latch and the lower latch from the extended position to the retracted position. The actuator rod has an inner end attached to the connecting arm and an outer end attached to an inner sleeve of the at least one of the upper latch and the lower latch, and the inner sleeve is movably disposed within an outer housing and biased by a biasing element towards the extended position. The lock set further includes a handset, and rotating the handset in a clockwise direction or a counter clockwise direction rotates the central shaft of the lock set and thereby simultaneously moves the at least two of the central latch, the upper latch and the lower latch from the extended position to the retracted position to release the panel from the frame.

BRIEF DESCRIPTION OF THE DRAWINGS

The aforementioned aspects, objects, features, advantages and exemplary embodiments of the present invention will be more fully understood and appreciated when considered in conjunction with the accompanying drawing figures, in which like reference characters designate the same or similar parts throughout the several views.

DETAILED DESCRIPTION OF EMBODIMENTS OF THE INVENTION

Figure 1:
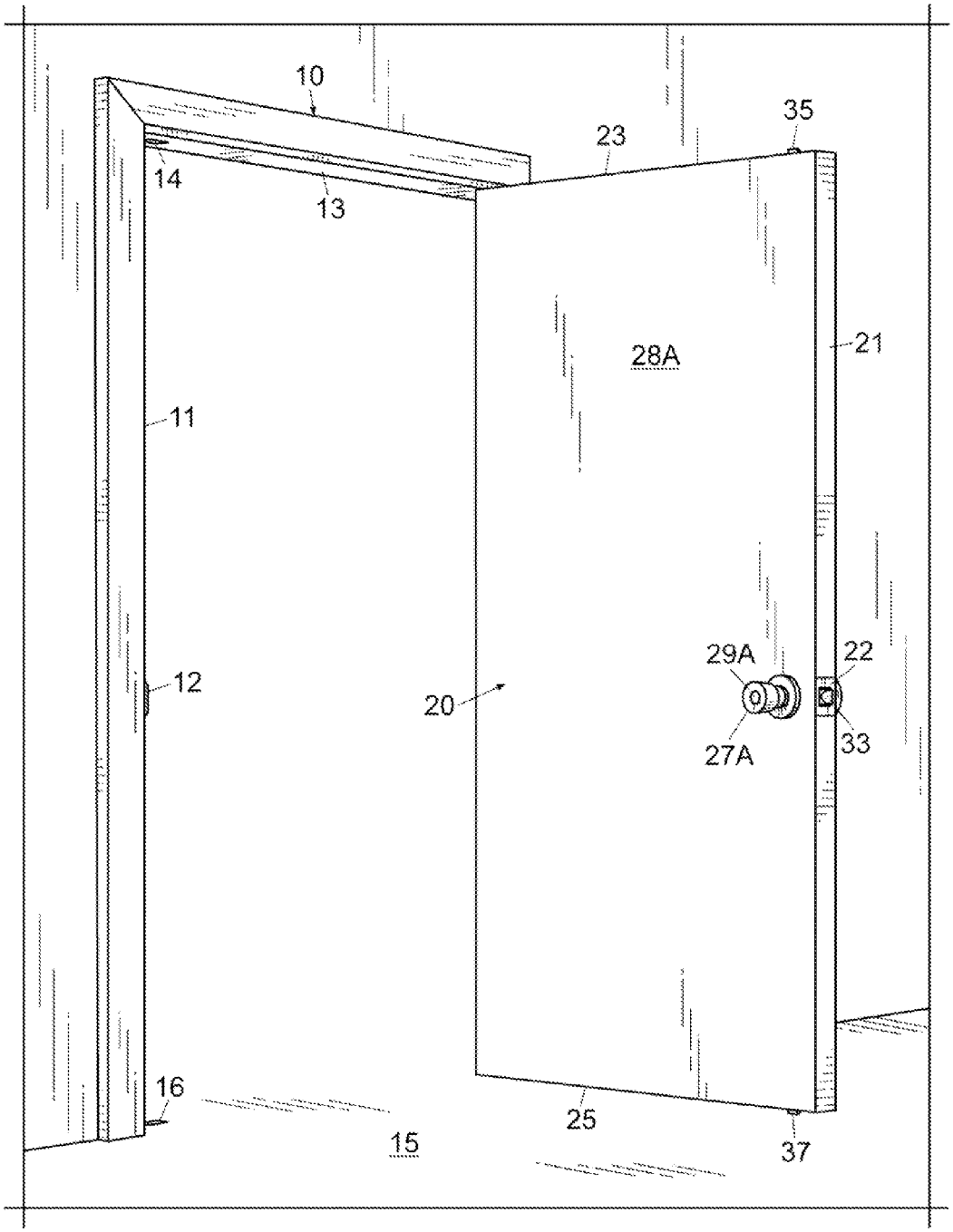
FIG. 1 is an environmental perspective view illustrating a door frame and a left-hand door including a door latch for retaining the door to the door frame in a closed configuration according to an exemplary embodiment of the present invention, with the door being shown in an opened configuration.

For a better understanding of the present invention and its operation, turning now to the drawings, FIG. 1 illustrates a door frame, indicated generally by reference character 10, and a left-hand door, indicated generally by reference character 20, with the door shown in an opened configuration. The door 20 includes a three-way door latch, indicated generally by reference character 30 (see FIG. 2) constructed according to an exemplary embodiment of the present invention. The door frame 10 and the door 20 are substantially of a conventional type with the exception of the modifications described herein necessary for operation in conjunction with the improved door latch 30 of the invention.

As shown in FIG. 1, the door frame 10 comprises a latch-side vertical jamb 11 having a striker plate 12 and defining a recess (not visible in FIG. 1) for receiving a conventional sliding latch mounted within the door 20 in a known manner. The sliding latch has a tapered, or beveled, end protruding outwardly from the door 20 and configured for engaging the striker plate 12 on the interior edge of the vertical jamb 11 of the door frame 10 while the door is being moved from the opened configuration to a closed configuration. Accordingly, the sliding latch is also commonly referred to as a striker plate latch. The sliding, or striker plate, latch comprises an inner sleeve that is slidably disposed within a stationary outer housing. The inner sleeve is biased, for example by a linear spring positioned between the inner sleeve and the outer housing, such that the tapered, or beveled, end protrudes outwardly beyond the door 20 unless the inner sleeve is retracted into the outer housing against the biasing force exerted on the movable inner sleeve by the linear spring. The foregoing general description of a conventional sliding, or striker plate, latch and its operation are included for purposes of providing a complete understanding of the three-way door latch of the present invention. However, as will be readily understood and appreciated by those skilled in the art, it is contemplated that other mechanisms for engaging a recess defined by a door frame, including by way of example and not limitation a conventional deadbolt, may be suitable for use with the door latch of the present invention.

As depicted by the exemplary embodiment shown and described herein, the recess defined by the vertical jamb 11 of the door frame 10 is configured to receive a biased central latch 32 (see FIG. 2) of the door latch 30 when the door 20 is in the closed configuration. The door frame 10 further comprises a horizontal lintel 13 having a striker plate 14 and defining a recess (not visible in FIG. 1). As depicted by the exemplary embodiment shown and described herein, the recess defined by the horizontal lintel 13 of the door frame 10 is configured to receive a biased upper latch 34 (see FIG. 2) of the door latch 30 when the door 20 is in the closed configuration. The door frame 10 may further comprise a horizontal threshold, or sill, having a striker plate 16 and defining a recess (not visible in FIG. 1). Alternatively, as illustrated in FIG. 1, the striker plate 16 may be mounted on a floor 15 defining a recess for the striker plate 16 immediately beneath the striker plate 14 provided on the horizontal lintel 13. Regardless, as depicted by the exemplary embodiment shown and described herein, the recess defined by the horizontal threshold or sill, or the floor 15, is configured to receive a biased lower latch 36 (see FIG. 2) of the door latch 30 when the door 20 is in the closed configuration. Door frame 10 further comprises a hinge-side vertical jamb that is hidden from view behind door 20 in FIG. 1. The hinge-side vertical jamb is provided with one or more hinge plates (not shown) operable for cooperating with corresponding hinges (not shown) mounted on the door 20, such that the door pivots about the hinges relative to the door frame 10 between the opened configuration and the closed configuration in a well-known and conventional manner.

Similarly, the door 20 comprises a latch-side vertical edge 21 having a guide plate 22 defining a through opening. As depicted by the exemplary embodiment shown and described herein, the opening defined by the guide plate 22 is configured to guide the protruding end (or deadbolt) 33 of the central latch 32 between a retracted, or unlatched, position wherein the protruding end does not engage with the door frame 10, and an extended, or latched, position wherein the protruding end of the central latch frictionally engages with the door frame within the recess defined by the vertical jamb 11. Door 20 further comprises a horizontal top edge 23 having a guide plate 24 (not visible in FIG. 1, see e.g., FIG. 3) defining a through opening. As depicted by the exemplary embodiments provided herein, the opening defined by the guide plate 24 is configured to guide the protruding end (or deadbolt) 35 of the upper latch 34 between a retracted, or unlatched, position wherein the protruding end does not engage with the door frame 10, and an extended, or latched, position wherein the protruding end of the upper latch frictionally engages with the door frame within the recess defined by the lintel 13. Door 20 further comprises a horizontal bottom edge 25 having a guide plate 26 (not visible in FIG. 1, see FIG. 2) defining a through opening. As depicted by the exemplary embodiment shown and described herein, the opening defined by the guide plate 26 is configured to guide the protruding end (or deadbolt) 37 of the lower latch 36 between a retracted, or unlatched, position wherein the protruding end does not engage with the door frame 10, and an extended, or latched, position wherein the protruding end of the lower latch frictionally engages with the door frame within the recess defined by the threshold or sill, or floor 15. The door 20 further comprises an exterior handle, or handset, 27A disposed on an exterior side 28A of the door, and an interior handle, or handset 27B disposed on an interior side 28B of the door 20 that is hidden from view in FIG. 1. If desired, the interior handset 27B may be provided with a lock 29A that is operable for preventing the exterior handset 27A from being turned to unlatch the three-way door latch 30 and open the door 20 in a known manner.

Figure 2:
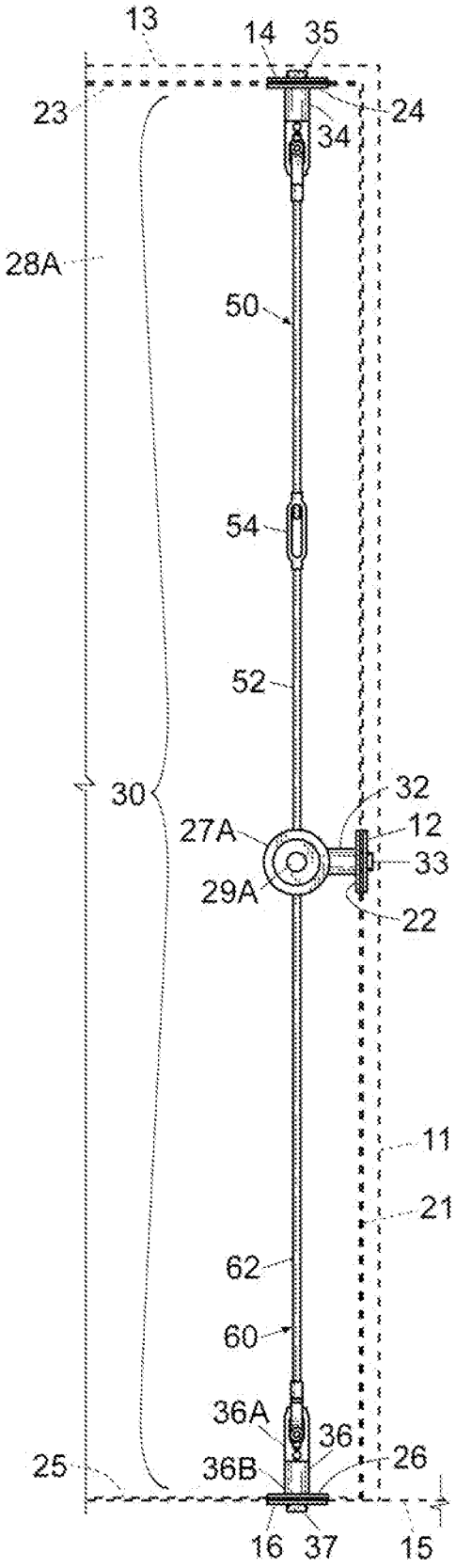
FIG. 2 is an elevation view showing the door latch of FIG. 1 from an exterior side of the door, with the door being shown in the closed configuration and with the door and the door frame indicated by hidden lines for purposes of clarity.
Figure 3:
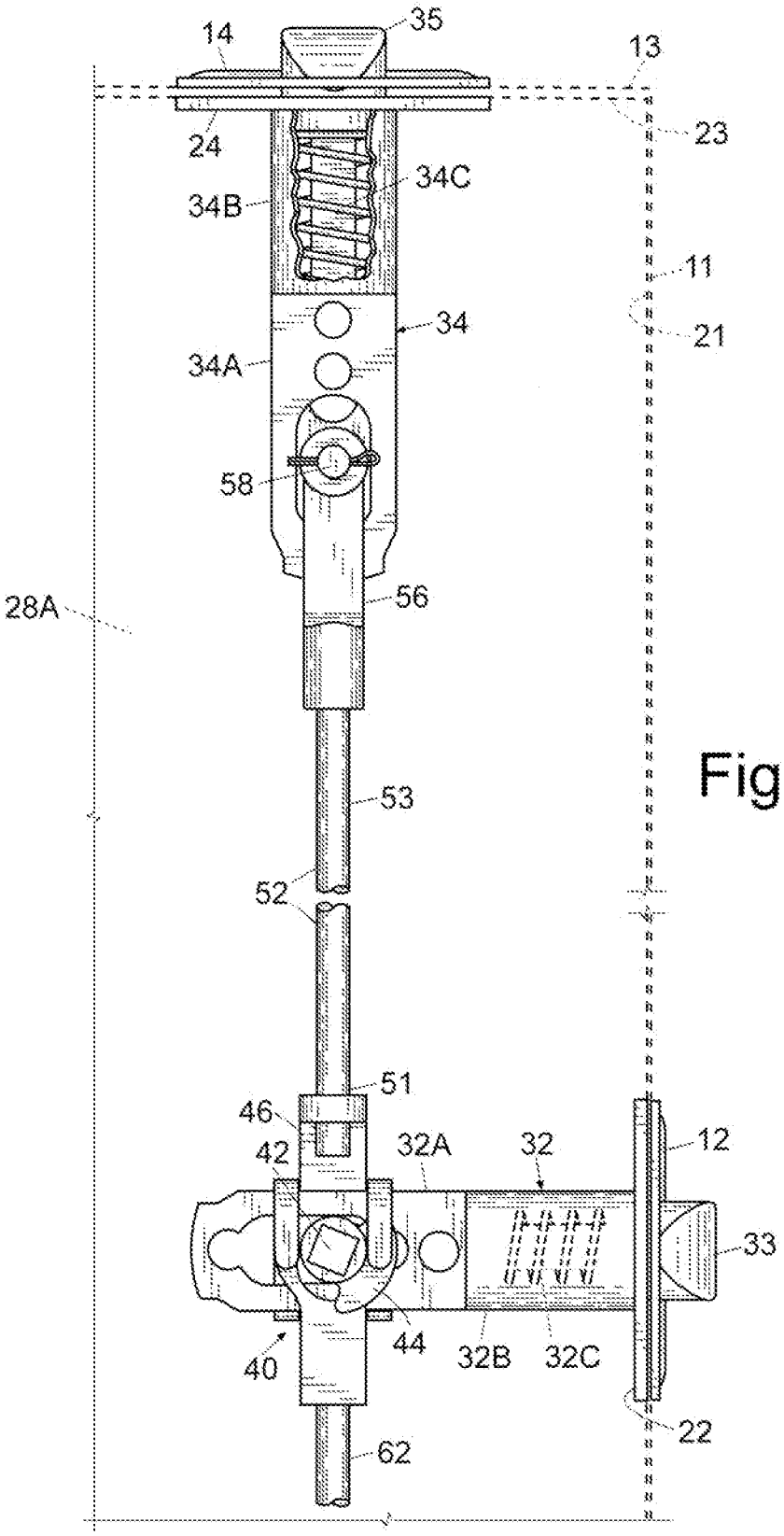
FIG. 3 is an enlarged, partial elevation view showing a portion of the door latch of FIG. 1 from an exterior side of the door, with the door being shown in the closed configuration and with the door and the door frame indicated by hidden lines and the exterior handset removed for purposes of clarity.
Figure 4:
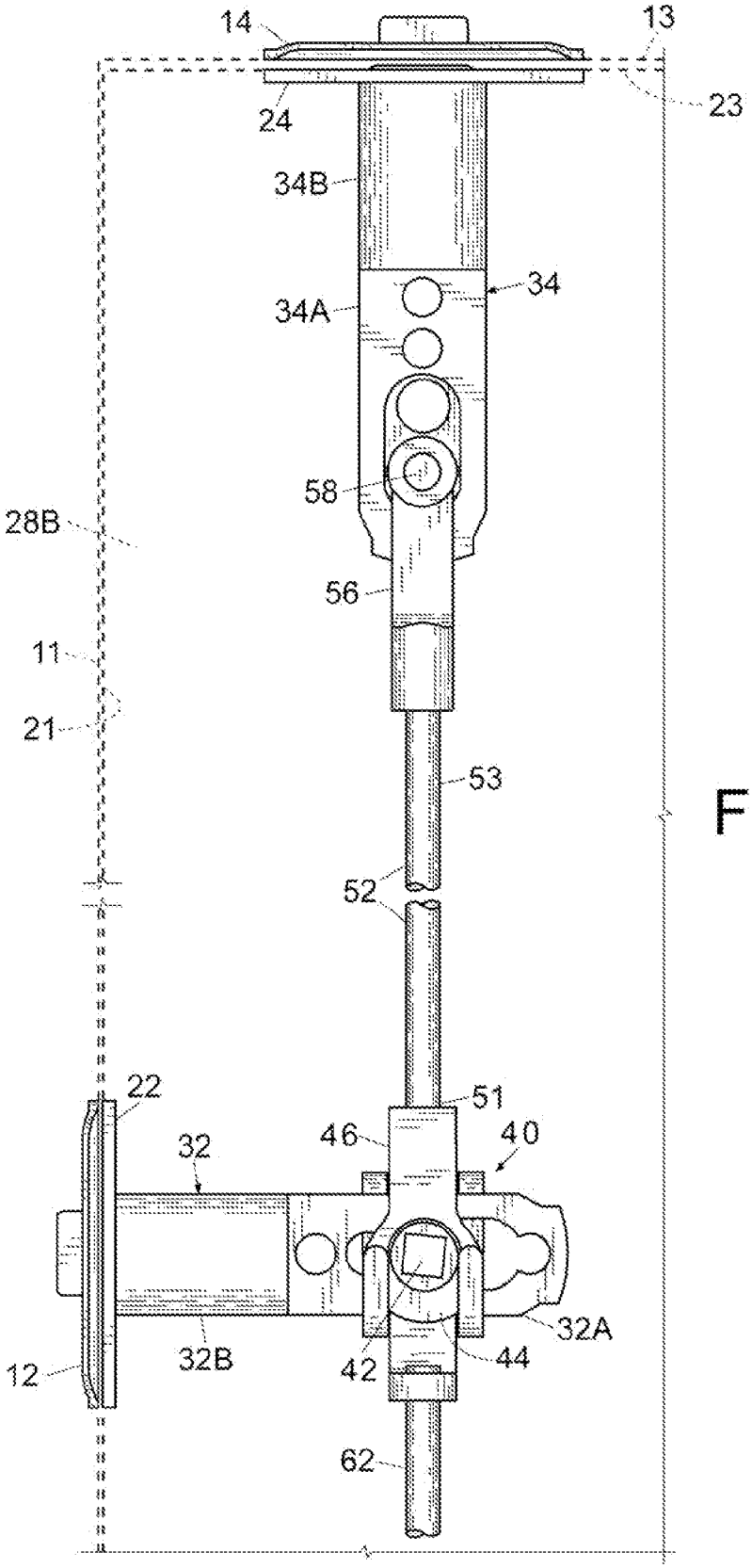
FIG. 4 is an enlarged, partial elevation view showing a portion of the door latch of FIG. 1 from an interior side of the door, with the door being shown in the closed configuration and with the door and the door frame indicated by broken lines and the interior handset removed for purposes of clarity.
Figure 5:
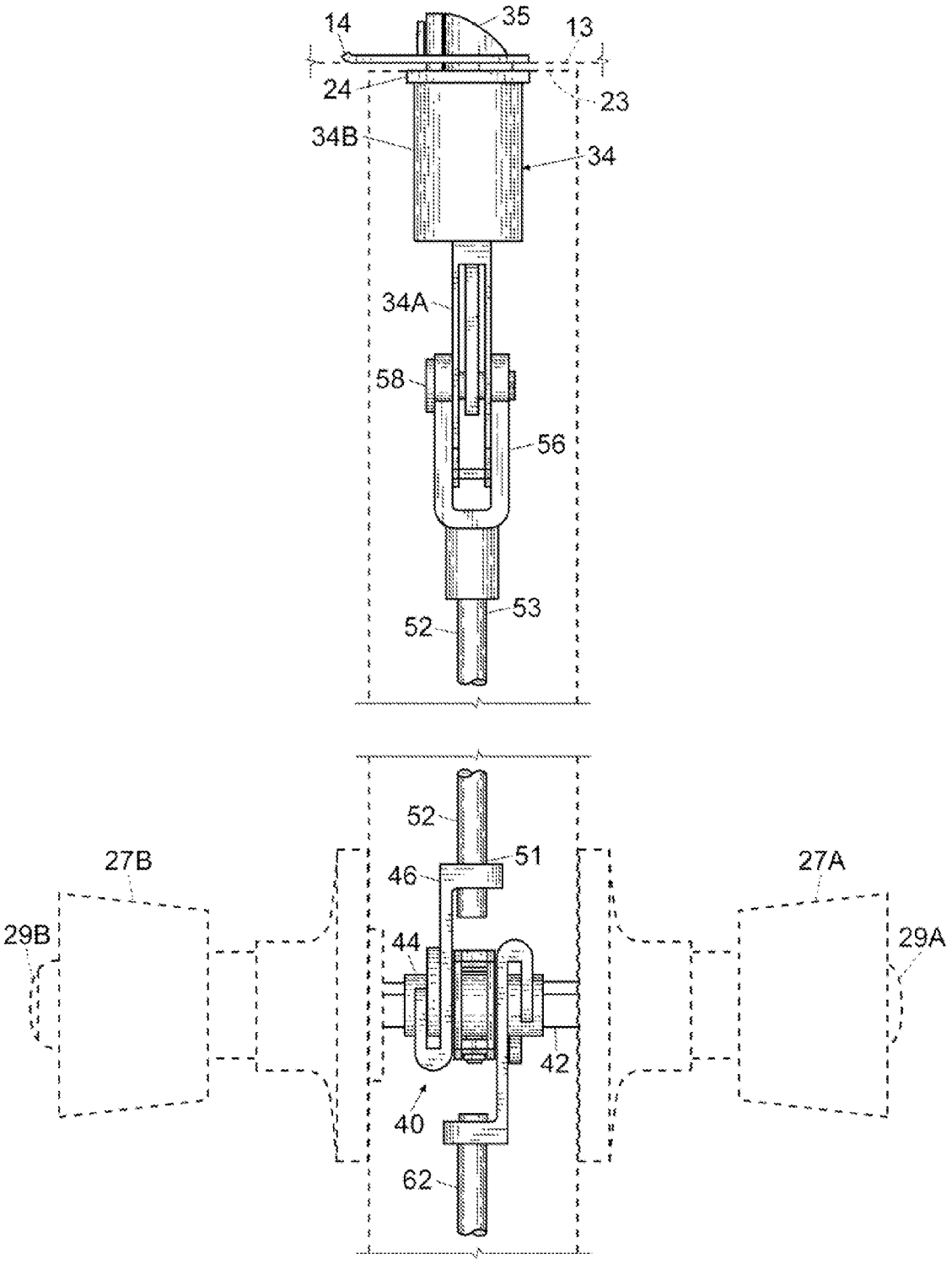
FIG. 5 is an enlarged, partial side view showing a portion of the door latch of FIG. 1 from a hinge-side of the door, with the door frame and the door indicated by hidden lines for purposes of clarity.

The exemplary embodiment of the door latch 30 illustrated in FIG. 1 is depicted in greater detail in FIGS. 2-5. FIG. 2 is an elevation view showing the door latch 30 in a locked or latched configuration as viewed from the exterior side 28A of the door 20. As previously mentioned, an exterior handset 27A is disposed on the exterior side 28A of the door and an interior handset 27B is disposed on the interior side 28B of the door 20, which is hidden from view in FIG. 2. The exterior handset 27A is provided with a lock 29A, for example a keyway configured for receiving a conventional mechanical key to lock the exterior handset against rotation in a known manner. Alternatively, the lock 29A may be configured for use with a magnetic key, a radiofrequency (RF) or an electronic key or other security reader. Regardless, the lock 29A is operable for preventing a lock set 40 (see FIG. 3, FIG. 4) disposed within the door 20 from being actuated by rotation of the exterior handset 27A. If desired, the interior handset 27B may likewise include a lock button 29B (see FIG. 5) operable for preventing the exterior handset 27A from being rotated to actuate the lock set 40, and thereby release the plurality of door latches from engaging with the door frame 10 with the door 20 in the closed configuration.

FIG. 2 shows the door latch 30 comprises a plurality, and in particular, three separate door latches consisting of a central latch 32, an upper latch 34 and a lower latch 36. The door latches 32, 34, 36 may be any type of door latch having a protruding end (or deadbolt) 33, 35, 37 that is configured to engage a corresponding recess provided in the door frame 10 in an extended (latched or locked) position, and is capable of being disengaged from the recess in a retracted (unlatched or unlocked) position, such that the door 20 can be moved from a closed configuration to an opened configuration. As shown herein, the protruding ends 33, 35, 37 of the latches 32, 34, 36 may be biased towards the extended position, such that the protruding ends of the latches engage the corresponding recesses in the door frame 10 when the door 20 is in the closed configuration. It should be noted that at least the central latch 32 alternatively may engage a recess, opening, slot or the like in another generally planar, hinged panel, for example another door adjacent to the door 20 to form a double door set in a known manner. It should also be noted that lower actuating rod assembly 60 and lower sliding latch 36 are configured essentially identical to and operate in essentially the same manner as upper actuating rod assembly 50 and upper sliding latch 34. Accordingly, for purposes of brevity, only the configuration and the operation of the upper actuating rod assembly 50 and upper sliding latch 34 will be described in greater detail hereafter, it being understood that the configuration and operation of the lower actuating rod assembly 60 and the lower sliding latch 36 is essentially the same, except as indicated and in the opposing direction relative to lock set 40. By way of example and not limitation, the latches 32, 34, 36 in the exemplary embodiment shown and described herein are conventional sliding latches, also commonly referred to as striker plate latches. As previously described, each sliding, or striker plate, latch 32, 34, 36 comprises an inner sleeve 32A, 34A 36A that is movably, and more particularly, slidably disposed within a stationary outer housing 32B, 34B, 36B. In addition, the inner sleeve is biased outwardly by a biasing element 32C (dashed line), 34C, and the biasing element (not shown) of 36, for example a linear spring, such that the protruding end 33, 35, 37 extends beyond the corresponding guide plate provided on the door 20 and the corresponding striker plate provided on the door frame 10, unless and until the inner sleeve is retracted into the outer housing against the biasing force exerted on the inner sleeve by the biasing element.

The central sliding latch 32 is operably coupled with a lock set 40 to operate in a conventional manner. More particularly, the lock set 40 comprises a rotatable central shaft 42 that extends transversely through the thickness of the door 20 and is attached to the exterior handset 27A disposed on the exterior side 28A of the door and to the interior handset 27B disposed on the interior side 28B of the door. The shaft 42 rotates with rotation of either the exterior handset 27A or the interior handset 27B, and in particular when either handset is turned. Rotation of the shaft 42 frictionally engages the inner sleeve 32A of the central sliding latch 32 in a known manner to produce a lateral tension force that is greater than the biasing force exerted on the inner sleeve by the biasing element 32C. Thus, rotation of the shaft 42 due to turning the exterior handset 27A or the interior handset 27B results in a sliding movement of the inner sleeve 32A relative to the outer housing 32B, and consequently, movement of the protruding end 33 of the central sliding latch 32 from its biased extended (i.e., latched or locked) position to a retracted (i.e., unlatched or unlocked) position.

As best seen in FIG. 2, upper sliding latch 34 is coupled to lock set 40 by an upper actuating rod assembly 50 preferably comprising a vertical actuator rod 52, and lower sliding latch 36 is coupled to lock set 40 by a lower actuating rod assembly 60 preferably comprising a vertical actuator rod 62. As shown, at least upper actuating rod assembly 50 includes an optional turnbuckle 54 for permitting gross adjustment of the length of actuator rod 52 between the lock set 40 and the upper sliding latch 34 to accommodate for differences in the distance between the medial through opening defined by the door 20 for receiving the lock set and the top edge 23 of the door. If desired, lower actuating rod assembly 60 likewise may be provided with a turnbuckle (not shown) or the like for gross adjustment of the length of actuating rod 62. Fine adjustment of the position of the actuator rod 52 relative to the upper sliding latch 34 and the position of the actuator rod 62 relative to the corresponding lower sliding latch 36 will be described hereafter with reference to upper actuating rod assembly 50. It should be noted that lower actuating rod assembly 60 and lower sliding latch 36 are configured essentially identical to and operate in essentially the same manner as upper actuating rod assembly 50 and upper sliding latch 34. Accordingly, for purposes of brevity, only the configuration and the operation of the upper actuating rod assembly 50 and upper sliding latch 34 will be described in greater detail hereafter, it being understood that the configuration and operation of the lower actuating rod assembly 60 and the lower sliding latch 36 is essentially the same, except as indicated and in the opposing direction relative to lock set 40.

As previously described, turning either exterior handset 27A or interior handset 27B causes rotation of the central shaft 42 of lock set 40. A cam 44 is rotatably attached to the shaft 42 on one side, for example the interior side of the lock set 40. Thus, rotation of the shaft 42 results in simultaneous complete or incomplete rotation of the cam 44. Rotation of cam 44 in turn drives a generally L-shaped connecting arm 46 that is rigidly attached to an inner end 51 of the actuator rod 52 of upper actuating rod assembly 50. By way of example and not limitation, turning exterior handset 27A in a clockwise direction or turning interior handset 27B in a counter clockwise direction causes rotation of shaft 42 and cam 44 in a corresponding direction, which in turn drives connecting arm 46 and actuator rod 52 in a vertically downward (or inward) direction relative to the door 20 and door frame 10. If desired, lock set 40 may be configured such that the reverse operation (i.e., either turning exterior handset 27A in a counter clockwise direction or turning interior handset 27B in a clockwise direction) likewise causes cam 44 to drive connecting arm 46 and actuator rod 52 in the vertically downward (or inward) direction. Regardless, operation of the lock set 40, and specifically rotation of shaft 42, results in downward vertical movement of actuator rod 52 relative to door 20 and door frame 10.

The opposite, outer end 53 of the actuator rod 52 of upper actuating rod assembly 50 is attached to the movable inner sleeve of the upper sliding latch 34. For example, the outer end 53 of actuator rod 52 may be provided with a clevis 56 that is pivotally attached to the inner sleeve 34A of the upper sliding latch 34 by means of a transverse shaft, pin or the like 58, such as a conventional cotter pin. If desired, fine adjustment of the position of the actuator rod 52 of the actuating rod assembly 50 relative to the position of the inner sleeve of the upper sliding latch 34 may be accommodated by providing a threaded engagement between the outer end 53 of the actuator rod 52 and the clevis 56. Regardless, the vertically downward (or inward) movement of the actuator rod 52 produces a vertical tension force that is greater than the biasing force exerted on the inner sleeve 34A by the biasing element 34C. Thus, rotation of the shaft 42 and cam 44 due to turning the exterior handset 27A or the interior handset 27B results in vertically downward (or inward) sliding movement of the inner sleeve 34A relative to the outer housing 34B, and consequently, movement of the protruding end 35 of the upper sliding latch 34 from its biased extended (latched or locked) position to a retracted (unlatched or unlocked) position.

As previously mentioned, the configuration and operation of the lower actuating rod assembly 60 and the lower sliding latch 36 is essentially the same as that of the upper actuating rod assembly 50 and the upper sliding latch 34. Accordingly, turning the exterior handset 27A or the interior handset 27B causes simultaneous movement of the protruding end 37 of the lower sliding latch 36 from its biased extended (latched or locked) position to a retracted (unlatched or unlocked) position against the biasing force exerted on the inner sleeve 36A by the biasing element (not shown) at lower sliding latch 36. As will be readily understood and appreciated by those skilled in the art from the detailed disclosure of the exemplary embodiment of the invention shown and described herein, a single mechanical operation of turning the exterior handset 27A or the interior handset 27B in a clockwise direction or a counter clockwise direction simultaneously retracts the protruding end (or deadbolt) 33, 35, 37 of the respective sliding latch 32, 34, 36 from the corresponding recess formed in the jamb 11 of the door frame 10, the lintel 13 of the door frame, and the sill of the door frame or the floor 15 so that the door 20 may be moved from the closed configuration to the opened configuration.

It should be noted that the exterior handset 27A and the interior handset 27B are typically biased, for example by a torsion spring, towards a neutral position in which no inward lateral tension force is exerted on the inner sleeve 32A of the central sliding latch 32, and no inward vertical tension force is exerted on the inner sleeve 34A of the upper sliding latch 34 and/or the inner sleeve 36A of the lower sliding latch 36. Thus, the inner sleeve 32A, 34A, 36A of the respective sliding latch 32, 34, 36 is biased outwardly relative to the outer housing 32B, 34B, 36B by the corresponding biasing element 32C, 34C, and the biasing element (not shown) of 36. As a result, when the door 20 is in the closed configuration, the sliding latches 32, 34, 36 retain the door in the closed configuration by frictional engagement of the protruding ends 33, 35, 37 of the respective sliding latches with the corresponding recesses formed in the door frame 10 or the floor 15 and/or by frictional engagement with the corresponding striker plates 12, 14, 16. Conversely, when the door 20 is in the opened configuration, the sliding latches 32, 34, 36 permit the door to be moved to the closed configuration by engagement of the protruding ends 33, 35, 37 of the respective sliding latches with the corresponding striker plates 12, 14, 16 to retract the protruding ends against the biasing force until the protruding ends are received within the corresponding recesses formed in the door frame 10 or the floor 15.

The foregoing detailed description of one or more exemplary embodiments of the present invention discloses a latching or locking device, apparatus, system and method for retaining a generally planar panel in engagement with a stationary frame. The latching device, apparatus, system and method is exemplified and embodied herein by a door latch for retaining a door to a door frame, another door or a floor at a plurality of locations adjacent a respective edge of the door. The door latch includes a central latch that is biased towards an extended position and at least one of an upper latch that is biased towards an extended position and a lower latch biased that is towards an extended position. The door latch further includes a lock set operable for simultaneously moving the central latch and the at least one of the upper latch and the lower latch from the extended position to a retracted position. However, it should be noted, and will be readily apparent to and understood and appreciated by those skilled in the art, that the drawings, figures, illustrations, examples and embodiments included herewith are intended for the purpose of providing a complete, accurate and enabling disclosure of the present invention and are not intended to limit the scope of the following appended claims in any manner. Accordingly, it is envisioned that other devices, apparatus, systems and methods comprising other mechanisms and movements may be utilized to accomplish the same result without departing from the intended scope of the appended claims. By way of example only and not limitation, the door latch may be provided with a locking element, member or the like configured to prevent turning of the exterior handset and the interior handset to operate the lock set, and thereby simultaneously retract the protruding end of each respective sliding latch to release the door from engagement with the door frame, floor or another door adjacent an edge of the door.

I claim:

1. A door latch for retaining a door with a stationary door frame, another door or a floor at a plurality of locations adjacent a respective edge of the door, the door latch comprising:

a central latch that is disposed within the door and biased in an extended position relative to a first edge of the door;

an upper latch that is disposed within the door and biased in an extended position relative to a second edge of the door and a lower latch that is disposed within the door and biased in an extended position relative to a third edge of the door; and a lock set comprising a rotatable central shaft operably coupled to cam that is in operable communication with an actuator arm via a connecting arm, the connecting arm defined by a pair of parallel fingers, each finger in parallel orientation relative to a longitudinal axis defined by the actuator rod, a center of the cam positioned between the fingers, and the cam defining two laterally distal portions, one finger contacting a first distal cam portion and the other finger contacting a second distal cam portion;

wherein rotatable operation of the central shaft in either rotational direction causes simultaneous movement of the central latch, the upper latch and the lower latch from the extended position to a retracted position, and wherein rotation of the cam in either rotational direction causes movement of the actuator rod of the at least one of the upper latch and the lower latch in an inward direction relative to the door, and wherein the actuator rod is operably coupled with an inner sleeve of the at least one of the upper latch and the lower latch, and wherein the inner sleeve is biased in the extended position by a biasing force, and wherein the movement of the actuator rod relative to the door creates a tension force that is greater than the biasing force such that the inner sleeve of the at least one of the upper latch and the lower latch moves from the extended position to the retracted position.

* * * * *